US006138532A

United States Patent [19]

McCann

[11] Patent Number: 6,138,532

[45] Date of Patent: Oct. 31, 2000

[54] WRENCH HAVING DRIVING DIRECTION INDICATOR

[76] Inventor: Frank McCann, 121, Yung Ho Road, Ta Ya Hsiang, Taichung Hsien, Taiwan

[21] Appl. No.: 09/310,781

[22] Filed: May 14, 1999

[51] Int. Cl.[7] ..... B25B 13/46

[52] U.S. Cl. ..... 81/63; 81/DIG. 5

[58] Field of Search ..... 81/63, 60, 61, 81/62, 63.1, 63.2, DIG. 5

[56] References Cited

U.S. PATENT DOCUMENTS

| | | | |
|---|---|---|---|
| 3,337,014 | 8/1967 | Sandrick | 81/DIG. 5 |
| 4,512,218 | 4/1985 | Chow . | |
| 5,000,066 | 3/1991 | Gentiluomo . | |
| 5,495,783 | 3/1996 | Slusar et al. | 81/63.2 |
| 5,794,496 | 8/1998 | Arnold | 81/63.2 |
| 5,913,954 | 6/1999 | Arnold et al. | 81/63.2 |

*Primary Examiner*—David A. Scherbel
*Assistant Examiner*—Daniel G. Shanley
*Attorney, Agent, or Firm*—Charles E. Baxley

[57] ABSTRACT

A wrench includes a handle having a head and a gear disposed in the head. A pawl is pivotally secured in the handle and has two ends selectively actuated to act onto the gear. A knob has a spring-biased projection for selectively actuating either of the ends of the pawl to engage with the gear. An indicator device may be used for indicating the active direction of the wrench by indicating the position of the knob. The pawl may be disposed outside of the gear or may be disposed in a cartridge that is rotatably received in an internal gear.

5 Claims, 3 Drawing Sheets

WRENCH HAVING DRIVING DIRECTION INDICATOR

BACKGROUND OF THE INVENTION

1. Field of the Invention

The present invention relates to a wrench, and more particularly to a wrench having an indicator for indicating the driving directions of the wrench.

2. Description of the Prior Art

Two typical wrenches are disclosed in U.S. Pat. No. 4,512,218 to Chow and U.S. Pat. No. 5,000,066 to Gentiluomo and comprise a gear, a pawl pivotally secured to the wrench and located beside the gear, and a knob including a spring-biased projection for selectively biasing the pawl to engage with the gear and for controlling the driving directions of the wrench. In which in Chow, the pawl is engaged within the gear for acting onto the gear from inside of the gear. In Gentiluomo, the pawl is provided beside the gear and actuated to act onto the gear from outside of the gear such that the driving directions of the wrenches may be arranged different from each other. However, no indicators are provided for indicating the driving directions of the wrench such that the users have to determine the driving direction of the wrench by trial and error method. This may waste the users a lot of time.

The present invention has arisen to mitigate and/or obviate the afore-described disadvantages of the conventional wrenches.

SUMMARY OF THE INVENTION

The primary objective of the present invention is to provide a wrench including an indicator for indicating the driving directions of the wrench.

In accordance with one aspect of the invention, there is provided a wrench comprising a handle including a head provided thereon and including a gear provided in the head, a pawl pivotally secured in the handle and including two ends selectively actuated to act onto the gear, a knob including a spring-biased projection engaged with the pawl for selectively actuating either of the ends of the pawl to engage with the gear, and an indicator device for indicating an active direction of the wrench.

The gear is an internal gear provided in the head, the wrench further includes a cartridge rotatably received in the internal gear, the pawl is pivotally secured in the cartridge, the cartridge includes a bore formed therein, the knob includes a shaft rotatably received in the bore of the cartridge, the cartridge includes an upper portion having the indicator device provided thereon, an engagement of the knob with the indicator device is provided for indicating the active direction of the wrench. The cartridge includes a notch formed therein for rotatably receiving the pawl therein.

The upper portion of the cartridge includes an opening formed therein and having a size greater than that of the bore of the cartridge for forming an annular shoulder between the bore and the opening of the cartridge, the upper portion of the cartridge includes a sector recess formed therein and communicating with the opening of the cartridge for receiving the knob. The knob includes a ring secured on top of the shaft and engaged with the annular shoulder of the cartridge for allowing the knob to be stably supported in place.

The sector recess of the cartridge includes two sides defined by two walls respectively, the walls are provided for engaging with the knob and for limiting a rotational movement of the knob relative to the cartridge. The indicator device includes two indicators provided in the recess and located close to the walls of the cartridge.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
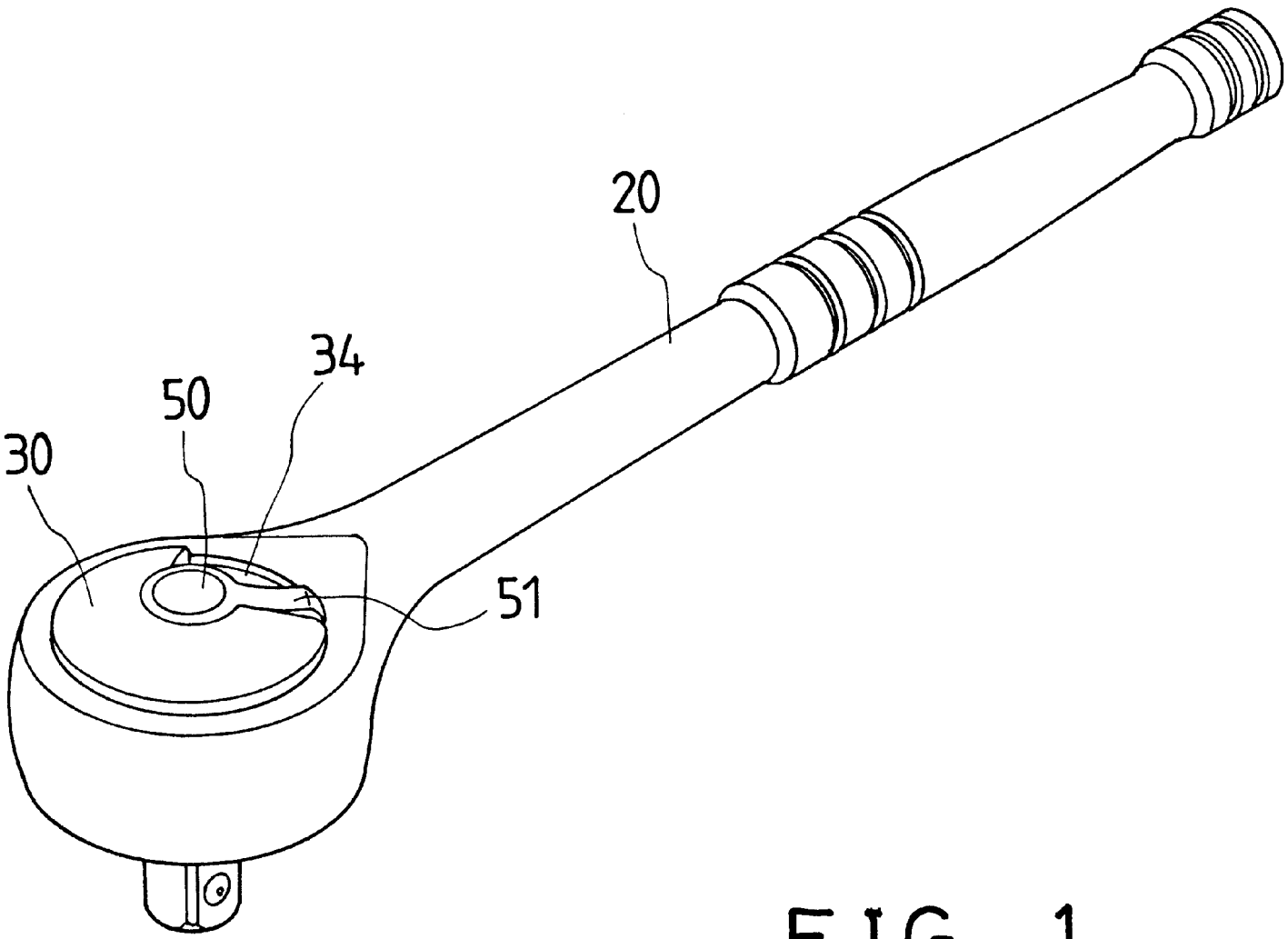
FIG. 1 is a perspective view of a wrench in accordance with the present invention.
Figure 2:
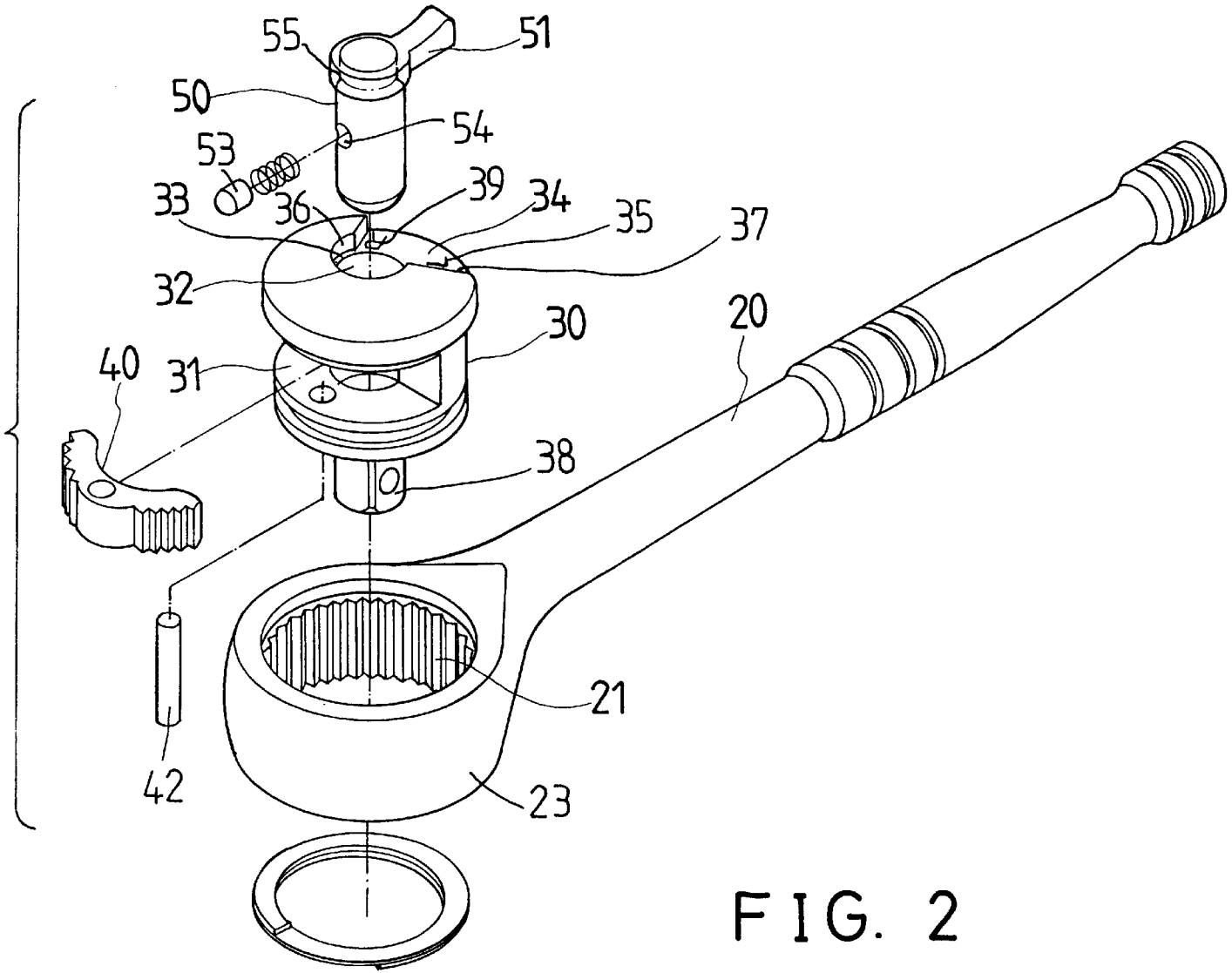
FIG. 2 is an exploded view of the wrench.

Referring to the drawings, and initially to FIGS. 1 and 2, a wrench in accordance with the present invention comprises a handle 20 including a head 23 provided on one end thereof and including an internal gear 21 provided in the head 23. A cartridge 30 is rotatably received in the internal gear 21 of the head 23 and includes a bore 32 vertically formed in the center portion thereof and includes a notch 31 formed in the middle portion thereof and facing away from the handle 20. A pawl 40 is pivotally received in the notch 31 of the cartridge 30 at a pivot pin 42 and includes two ends for engaging with the gear 21 and for controlling the driving directions of the cartridge 30 relative to the head 23 of the wrench. The cartridge 30 includes a stud 38 extended downward therefrom for engaging with a socket or the other tool members or for engaging with the fasteners directly.

The cartridge 30 includes an opening 36 formed in the upper portion thereof and having a size slightly greater than that of the bore 32 of the cartridge 30 for forming an annular shoulder 33 between the bore 32 and the opening 36 of the cartridge 30. The cartridge 30 further includes a sector shaped recess 34 formed in the upper portion and facing rearward toward the handle 20 and communicating with the opening 36 and thus with the bore 32 of the cartridge 30. The sector recess 34 includes two sides defined by two walls 37. The cartridge 30 includes two indicators 35, 39 provided in the upper portion thereof and located in the recess 34 and located close to the walls 37. A shaft 50 is rotatably received in the bore 32 of the cartridge 30 and includes a spring-biased projection 53 provided in the front portion thereof and received in an aperture 54 that formed in the front portion of the shaft 50. The spring-biased projection 53 may act onto the pawl 40 for biasing either of the two ends of the pawl 40 to engage with the gear 21 when the shaft 50 is rotated by a knob 51 that is received in the opening 36 and the recess 34 of the cartridge 30. The knob 51 includes a ring 55 secured on top of the shaft 50 and engaged with the annular shoulder 33 of the cartridge 30 for allowing the knob 51 to be stably supported in place and for allowing the knob 51 to be rotated smoothly. The knob 51 may be rotated by the user in order to selectively actuate the spring-biased projection 53 to engage with the pawl 40.

Figure 3:
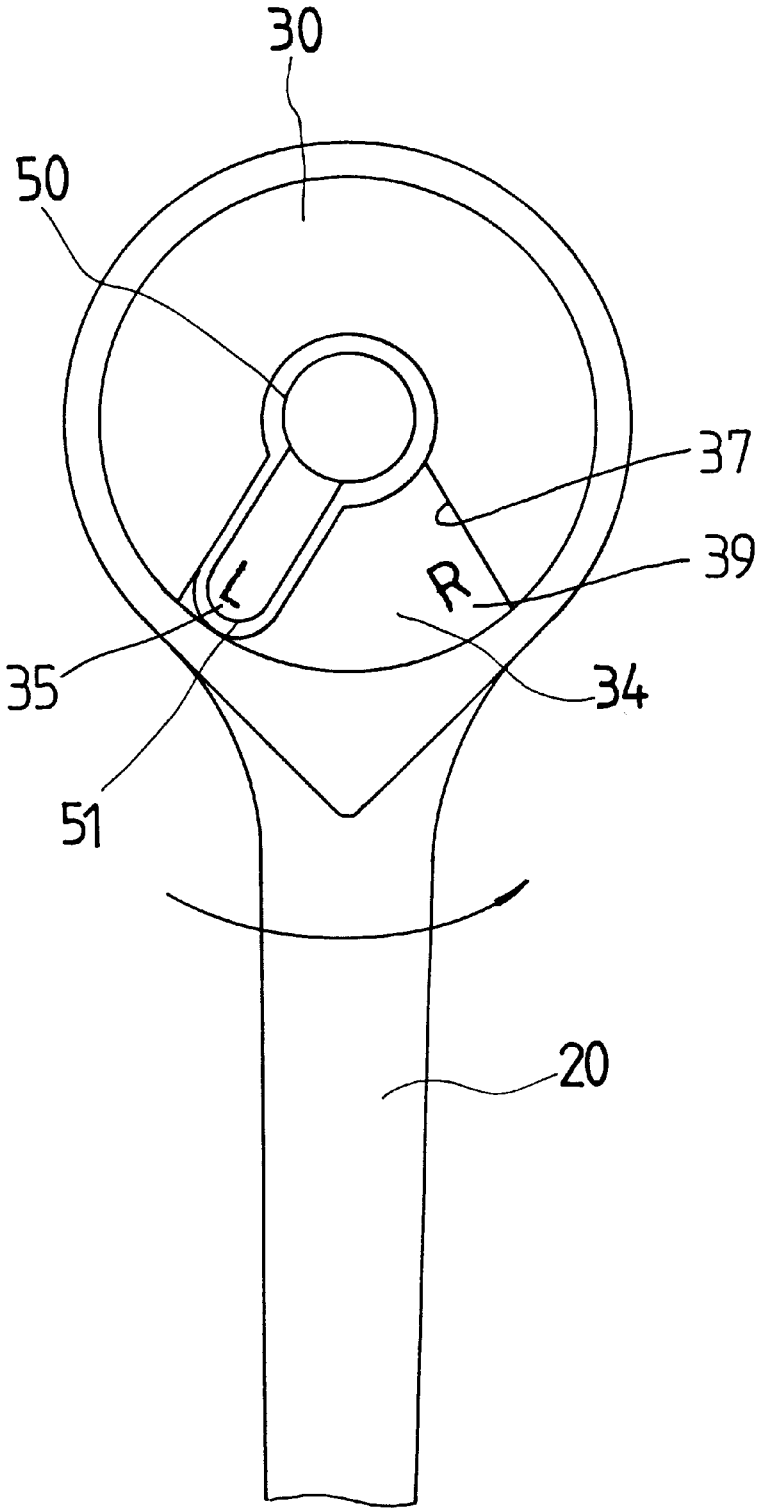
FIG. 3 is a top view illustrating the operation of the direction indicator of the wrench.

As best shown in FIG. 3, the indicator 35 includes a character "L" or "CCW" for indicating one driving direction of the wrench or for indicating that the handle 20 may be rotated in a counterclockwise direction from the left to the right in order to drive the fastener in the counterclockwise direction, for example. When the knob 51 is rotated to the side of the indicator 39 "R" or "CW", the wrench may be actuated to drive the fastener in the reverse direction. The knob 51 may be made of transparent material for allowing the user to see the indicators 35, 39. Alternatively, the indicator 39 "R" or "CW" may be used for indicating the driving direction of the wrench when the knob 51 is engaged on the indicator 35; and the indicator 35 "L" or "CCW" may be used for indicating the driving direction of the wrench when the knob 51 is engaged on the indicator 39.

In operation, as shown in FIG. 3, the walls 37 of the cartridge 30 may be used for limiting the rotational movement of the knob 51 and for determining the working positions of the knob 51 when the knob 51 is engaged with either of the walls 37. When the knob 51 is engaged on either of the indicators 35, 39, either of the indicators 35, 39 may be used for indicating the acting direction of the wrench.

The indicators 35, 39 may also be applied to the wrench that has the pawl 40 rotatably secured to the handle 20 of the wrench and located outside of the gear 21 as that disclosed in U.S. Pat. No. 5,000,066 to Gentiluomo.

Accordingly, the wrench in accordance with the present invention includes an indicator for indicating the driving directions of the wrench.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench comprising:

a handle including a head provided thereon and including an internal gear provided in said head, a cartridge rotatable received in said internal gear, said cartridge including a bore formed therein and including an upper portion, a pawl pivotally secured in said cartridge and including two ends selectively actuated to act onto said internal gear, a knob including a shaft rotatable received in said bore of said cartridge and including a spring-biased projection engaged with said bawl for selectively actuating either of said ends of said bawl to engage with said internal gear, and an indicator device provided on said upper portion of said cartridge for indicating an active direction of said wrench, an engagement of said knob with said indicator device being provided for indicating the active direction of said wrench, wherein said upper portion of said cartridge includes an opening formed therein and having a size greater than that of said bore of said cartridge for forming an annular shoulder between said bore and said opening of said cartridge, said upper portion of said cartridge includes a sector recess formed therein and communicating with said opening of said cartridge for receiving said knob.

2. The wrench according to claim 1, wherein said knob includes a ring secured on top of said shaft and engaged with said annular shoulder of said cartridge for allowing said knob to be stably supported in place.

3. The wrench according to claim 1, wherein said sector recess of said cartridge includes two sides defined by two walls respectively, said walls are provided for engaging with said knob and for limiting a rotational movement of said knob relative to said cartridge.

4. The wrench according to claim 3, wherein said indicator device includes two indicators provided in said recess and located close to said walls of said cartridge.

5. The wrench according to claim 1, wherein said cartridge includes a notch formed therein for rotatably receiving said pawl therein.

* * * * *